US008075467B2

(12) United States Patent
Monti

(10) Patent No.: US 8,075,467 B2
(45) Date of Patent: Dec. 13, 2011

(54) DEVICE FOR ERECTING FLAT-FOLDED TUBULAR BLANKS

(75) Inventor: Giuseppe Monti, Pianoro (Bologna) (IT)

(73) Assignee: Marchesini Group S.p.A., Pianoro (Bologna) (IT)

( * ) Notice: Subject to any disclaimer, the term of this patent is extended or adjusted under 35 U.S.C. 154(b) by 333 days.

(21) Appl. No.: 12/391,295

(22) Filed: Feb. 24, 2009

(65) Prior Publication Data

US 2009/0247380 A1 Oct. 1, 2009

(30) Foreign Application Priority Data

Mar. 27, 2008 (IT) ..... BO2008A0194

(51) Int. Cl.
*B31B 1/80* (2006.01)

(52) U.S. Cl. ..... 493/309; 493/181; 493/313; 493/316; 493/317; 493/177

(58) Field of Classification Search ..... 493/177, 493/180, 181, 309, 313, 316, 317
See application file for complete search history.

(56) References Cited

U.S. PATENT DOCUMENTS

| | | | | |
|---|---|---|---|---|
| 4,285,679 | A * | 8/1981 | Wahle | 493/125 |
| 4,437,851 | A * | 3/1984 | Salenbo | 493/124 |
| 4,917,659 | A * | 4/1990 | Mohaupt et al. | 493/12 |
| 5,024,640 | A * | 6/1991 | Saitoh | 493/127 |
| 5,120,293 | A * | 6/1992 | Franklin | 493/125 |
| 5,207,630 | A * | 5/1993 | Decker et al. | 493/313 |
| 5,298,008 | A * | 3/1994 | Decker et al. | 493/313 |
| 5,514,068 | A * | 5/1996 | Calvert et al. | 493/315 |
| 6,915,622 | B2 * | 7/2005 | Spatafora | 53/458 |

* cited by examiner

*Primary Examiner* — Christopher Harmon
(74) *Attorney, Agent, or Firm* — William J. Sapone; Coleman Sudol Sapone P.C.

(57) ABSTRACT

The device for erecting flat-folded tubular blanks supplied in flat-folded form comprises a collecting group provided with first gripping means which are mobile between a pick-up station of the single tubular blanks from a store and an opening station of the single tubular blanks. An opening group is arranged in the opening station and provided with second gripping means for gripping the single flat-folded tubular blanks at a second surface thereof, opposite the first surface engaged by the first gripping means. The second gripping means are mobile between a gripping position of the single tubular blanks and a distanced opening position thereof. A folding organ is destined to progressively engage a free side of the single tubular blanks during the course of opening, for completing the erecting of the tubular blanks.

19 Claims, 8 Drawing Sheets

DEVICE FOR ERECTING FLAT-FOLDED TUBULAR BLANKS

BACKGROUND OF THE INVENTION

The invention relates to a device for erecting flat-folded tubular blanks, destined for use in packing machines.

In the prior art, various types of articles are packed in containers obtained from cardboard blanks. These blanks are supplied in a flat-folded tubular form and must therefore be opened-out to full volume so that articles to be packed can be inserted therein.

Packing machines therefore have to be provided with suitable devices for opening and folding the tubular blanks predisposed initially in flat-folded form in a store. The tubular blanks are opened and folded along prefixed preferential folding lines, usually known as score lines, so that they can receive articles in a vertical or horizontal direction.

Known erecting devices, made according to various operating modalities, do not fully satisfy the requirements of effectiveness of use, high operating velocity and functional simplicity required by cartoning machines. The prior art in particular comprises devices which predispose the tubular blank to be opened on a work plane and open it by means of special folding organs which cause the rotation of the sides of the blank about a respective folding line. This rotation arranges the adjacent sides of the tubular blank substantially at right-angles.

A drawback noted in prior-art devices consists in the fact that the rotation of the folding organs is often not able to ensure stable forming of the tubular blank in open configuration. The fold made about the score line is generally subject to an elastic return effect which tends to return the tubular blank at least partially into the flattened shape.

SUMMARY OF THE INVENTION

The task of the present invention is to obviate the cited drawbacks, by providing a device which enables effective and high-speed erection of tubular blanks in flattened form.

A further aim of the invention is to provide a device for erecting tubular blanks which is of simple constructional and functional concept, and which is versatile in use.

The stated aims are obtained according to a device for erecting flat-folded tubular blanks supplied in flat-folded form, comprising: a collecting group provided with first gripping means for gripping flat-folded single tubular blanks at a first surface thereof, which gripping means are alternatingly mobile in a longitudinal direction and in a suitable phase relation with a transport line of the tubular blanks when erected, between a pick-up station of the single tubular blanks from a store, in which the tubular blanks are predisposed in a flattened folded form, and an opening station of the single tubular blanks; an opening group arranged in the opening station and provided with second gripping means apt to grip the single flat-folded tubular blanks at a second surface thereof, opposite the first surface engaged by the first gripping means, the second gripping means being mobile in a substantially vertical direction between a near gripping position of the second surface of the single tubular blanks and a distanced opening position thereof; a folding organ arranged in the opening station and destined to progressively engage a free side of the second surface of the single tubular blanks during the course of opening operated by the second gripping means between the gripping position and the opening position, the folding organ being oscillatable about a folding axis which is parallel to a creasing line of the first surface and the second surface of the single tubular blanks, for completing the erecting of the tubular blanks.

BRIEF DESCRIPTION OF THE DRAWINGS

The characteristics of the invention are set out in the following, with particular reference to the figures of the drawings, in which.

Figure 1:
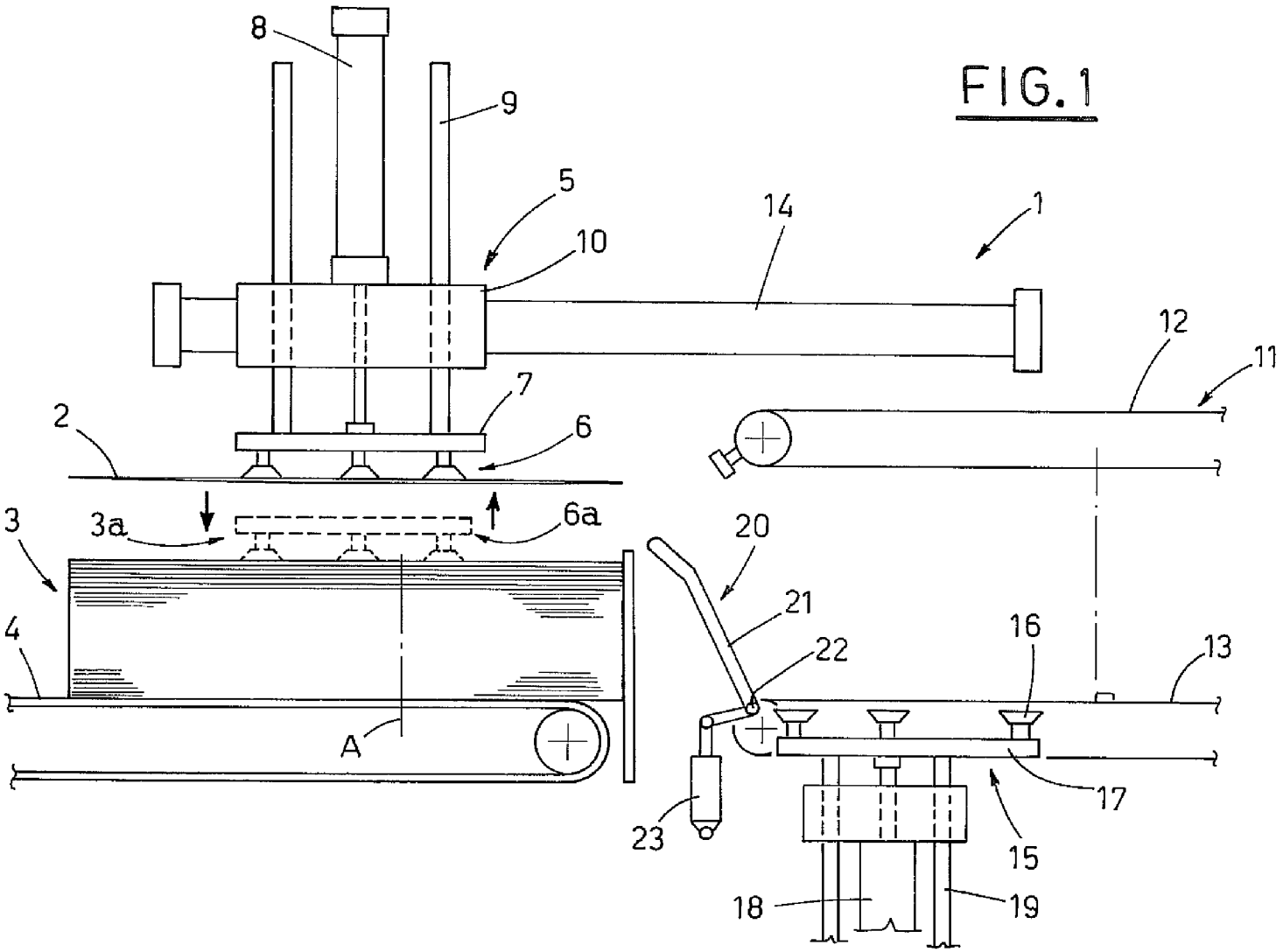
FIG. 1 is a schematic lateral view of the device for erecting tubular blanks in flattened form of the present invention.

FIGS. from 2 to 8 illustrate the same lateral view of the device in successive operating stages.

DESCRIPTION OF THE PREFERRED EMBODIMENTS

With special reference to the figures, 1 denotes in its entirety the device for erecting tubular blanks 2 provided in flat-folded form from a store 3. In more detail, the tubular blanks 2 are supplied in piles to the store 3 by a supply line 4.

The device 1 comprises a collecting group 5 provided with first gripping means 6, for example a plurality of sucker organs arranged in order on several rows which are transversal of the advancement direction, in order to grip single flat-folded tubular blanks 2 lying on the top of the pile of blanks predisposed in the store 3. In particular, the first gripping means 6 act on first upper surface of the tubular blanks 2. To this end, the first gripping means 6 are borne by a mobile frame 7 in a substantially vertical direction on command of a suitable actuator organ 8, between a lowered gripping position, denoted by a broken line **6*a*** in the figures, and a raised removing position.

The frame 7 of the gripping means 6 is guided, by guide stems 9, to a carriage 10 which is alternatingly mobile in a longitudinal direction and in suitable phase relation with a transport line 11 of the erected tubular blanks 2. The transport line 11 is formed in a known way by a pair of conveyor belts 12, 13, an upper belt and a lower belt, which face one another and which rotate in opposite directions. The carriage 10 is activated on sliding guides 14 by motor organs of known type, not illustrated for the sake of simplicity, between a pick-up station of the single tubular blanks 2 from the store 3 and an opening station of the tubular blanks 2.

An opening group 15 provided with second gripping means 16 is arranged in the opening station, which second gripping means 16 can be for example a plurality of sucker organs arranged orderedly on several rows which are transversal to the advancement direction, which grip the single flat-folded tubular blanks 2 at a second surface thereof, opposite the first surface which is engaged by the first gripping means 6. The second gripping means 16 are borne in turn by a mobile frame 17 in a substantially vertical direction, on command of a suitable actuator organ 18, between a close position of gripping the second surface of the single tubular blanks 2 and a distanced opening position. The frame 17 of the second gripping means 16 is guided by guide stems 19.

The device for erecting the tubular blanks 2 further comprises a folding organ 20 arranged in the opening station by a side of the opening group 15. The folding organ 20 is substantially constituted by a shaped rod 21 which progressively engages a free side of the second surface of the tubular blanks 2, during the opening run of the gripping means 16 of the opening group 15 between the gripping position and the opening position. The rod 21 of the folding organ 20 is pivoted about a folding axis 22, parallel to a score line of the first and second surfaces of the tubular blanks 2, and can be oscillated on command of an actuator organ 23 to complete the erection of the tubular blanks 2.

The functioning of the device for erecting the flat-folded tubular blanks is described herein below.

During the initial stage of the operating cycle, the collecting group 5 is arranged at the collecting station, above the store 3 (FIG. 1). The first gripping means 6 is then activated to descend into the lowered position 3*a,* on command of the actuator organ 8 such as to come into contact with the blank 2 arranged on top of the pile. Obviously sensor organs control the extent of the downwards run of the gripping means 6, according to the residual height of the pile of blanks 2.

Of especial relevance is the fact that the suckers constituting the gripping means 6 engage the upper surface of the tubular blank 2 on both sides thereof 2A, 2B defined by the score line made on the surface. For the sake of greater visibility a broken line A denotes the score line. This enables a solid grip of the tubular blank 2 over all the surface and ensures planarity thereof during transport, preventing any partial folding thereof from occurring by effect of the force of gravity.

Figure 2:
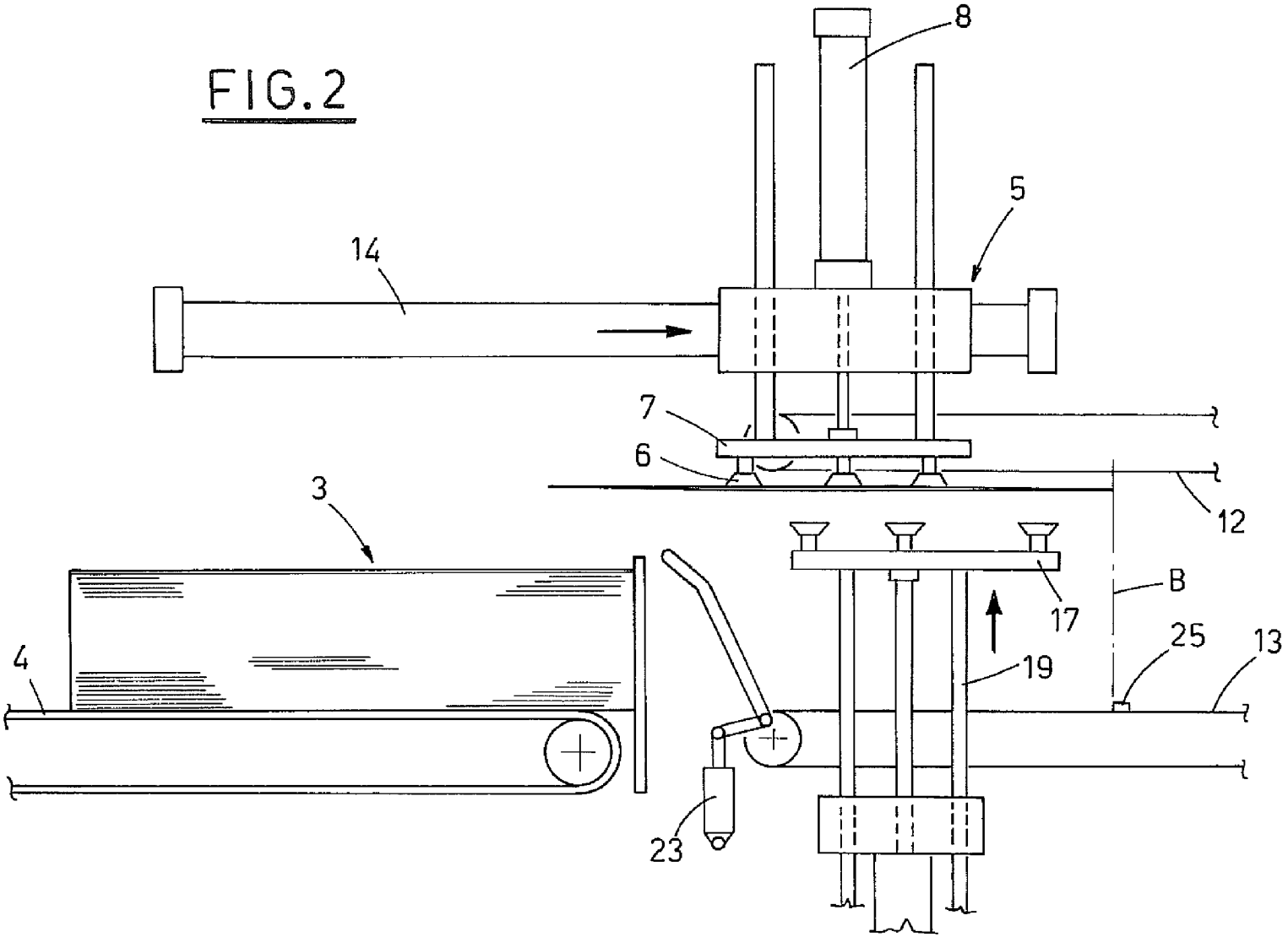
Figure 3:
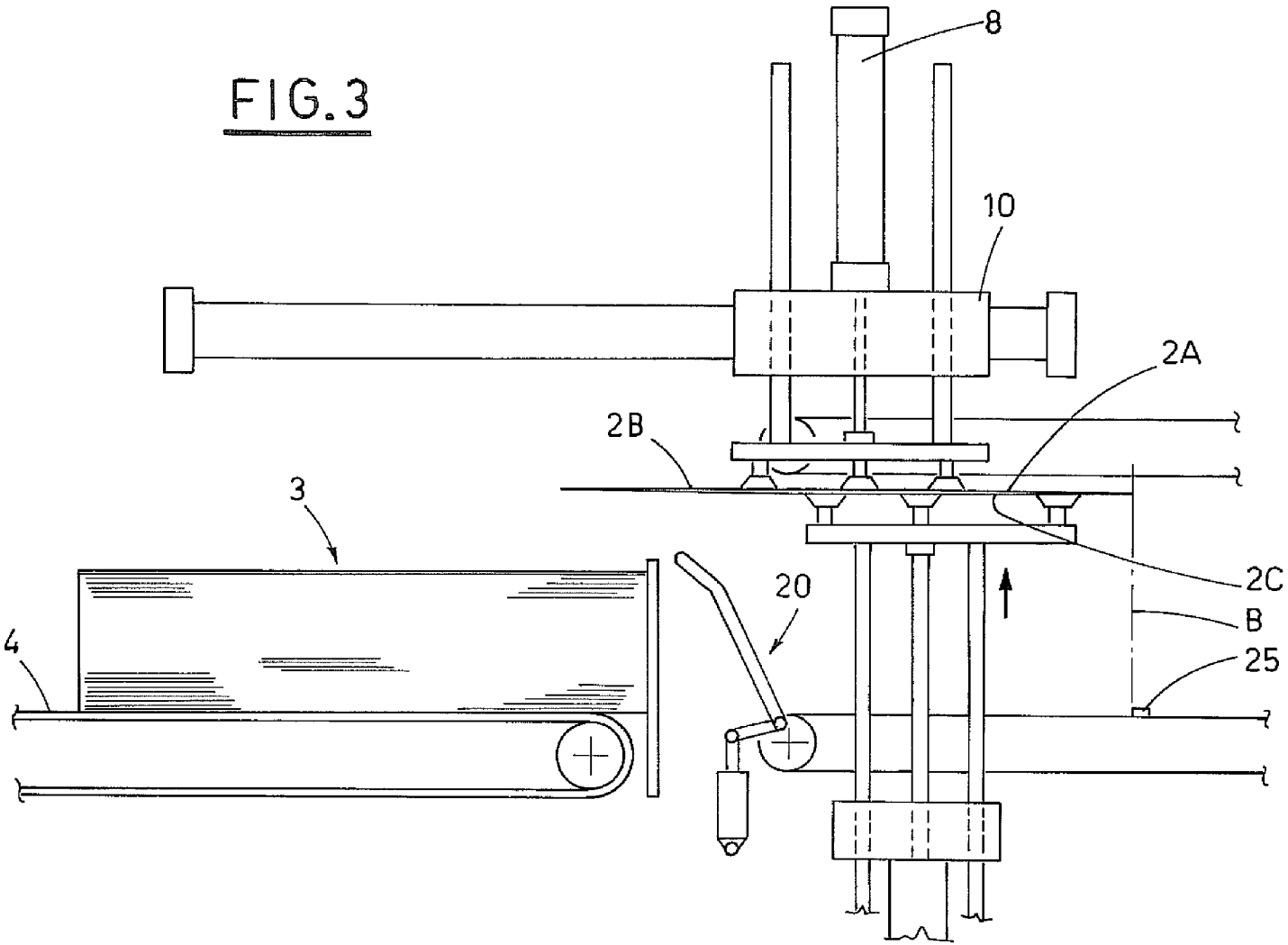

The tubular blank 2 gripped by the gripping means 6 is raised and thus translated by the collecting group to the opening station (FIG. 2). In suitable phase relation the second gripping means 16 of the opening group 15 arc activated, which engage the lower surface 2C of the flat-folded tubular blank 2, held in the opening station by the gripping means 6 of the collecting group (FIG. 3). It is stressed that the suckers constituting the second gripping means 16 are displaced with respect to the first gripping means 6, such as to engage the lower surface 2C of the tubular blank 2 only at the side arranged anteriorly according to the advancement direction and destined to function as lower base of the blank when erected.

Figure 4:
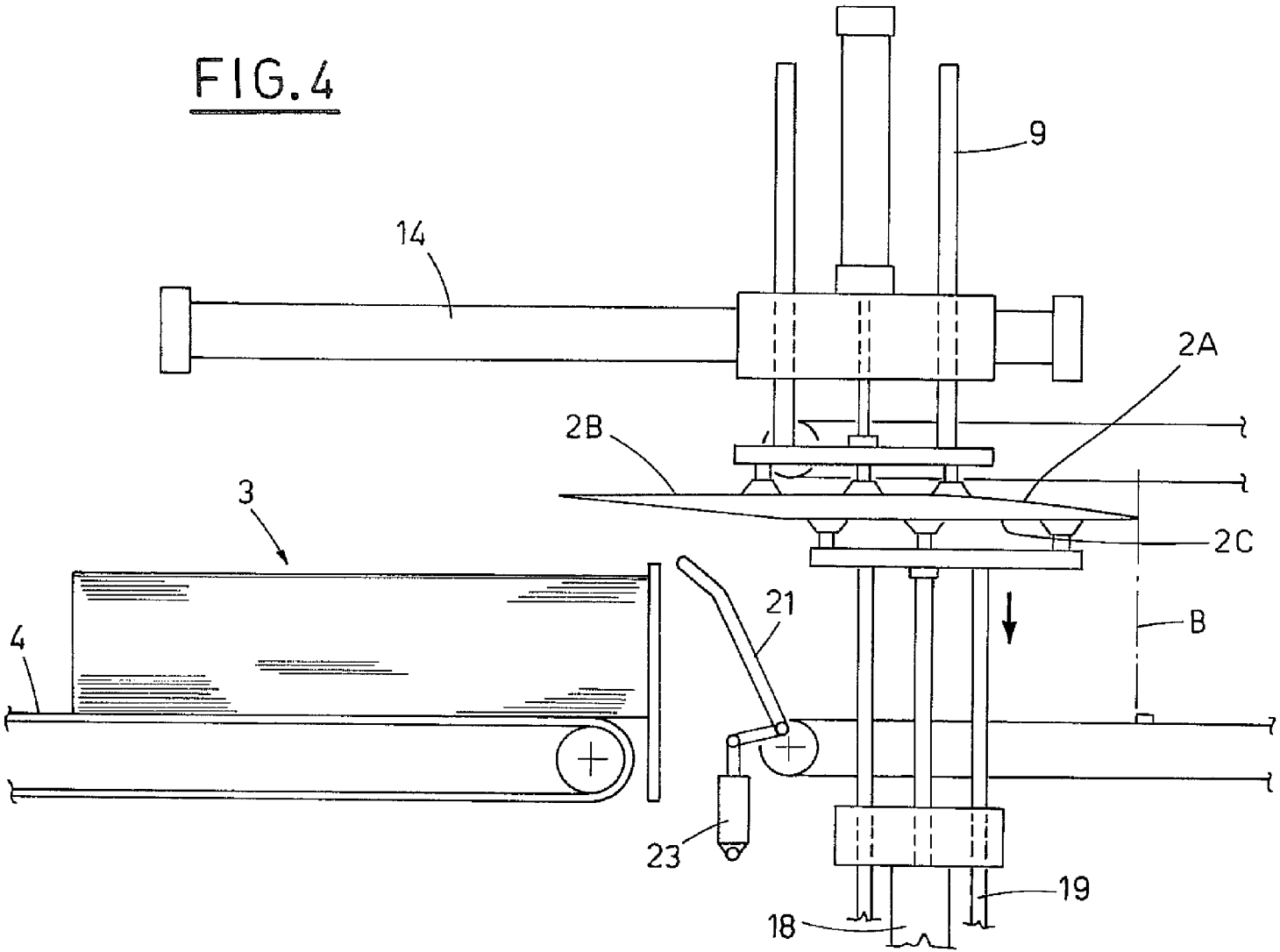

The return run of the gripping means 16 of the opening group 15 (FIG. 4) is then commanded. For an initial tract of the run, of limited entity, the gripping means 6 of the collecting group 5 retain the upper surface of the tubular blank 2, such as to ensure reciprocal detachment of the two limbs (close to one another) constituting the upper and lower surfaces of the blank.

Figure 5:
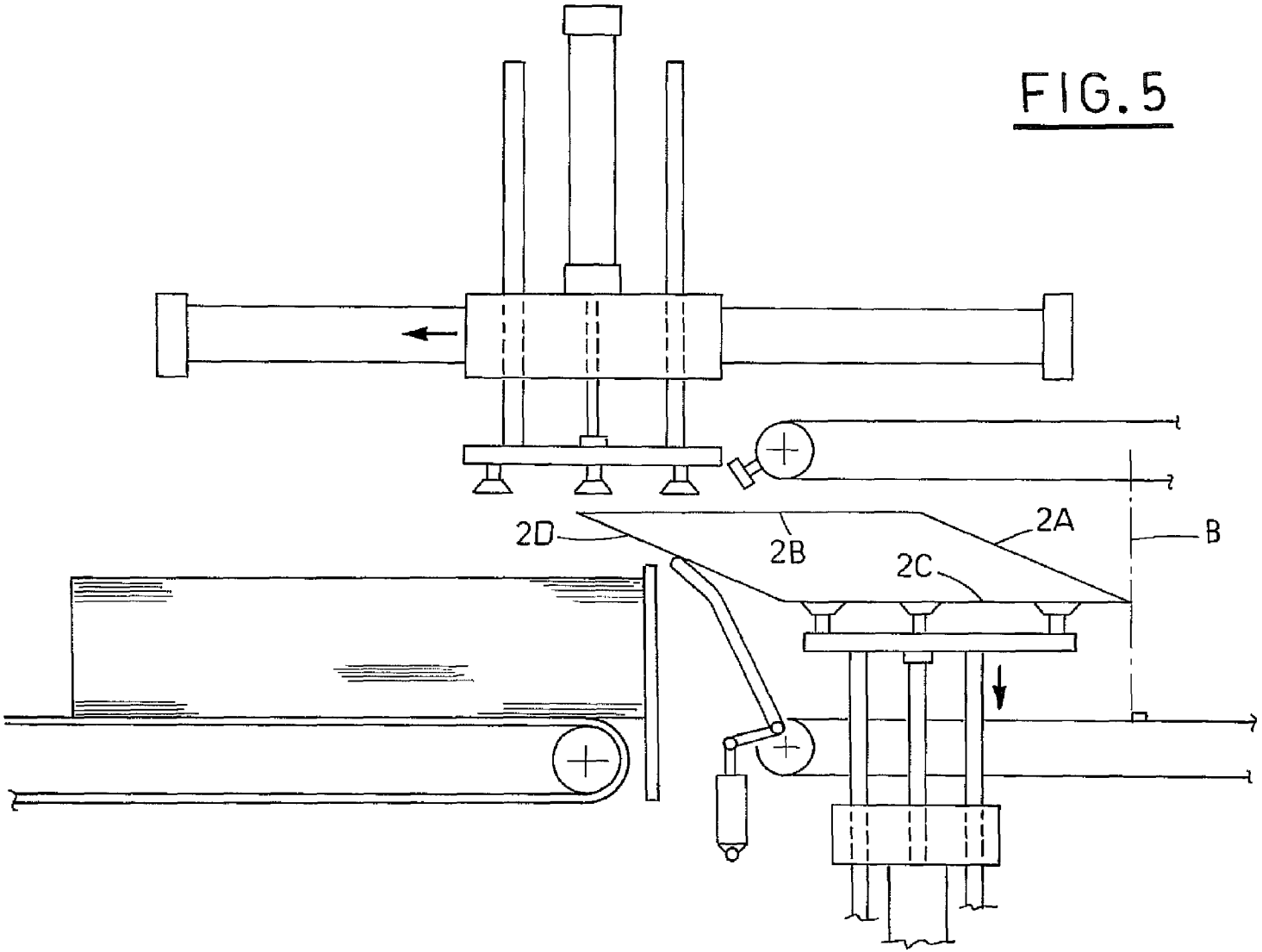

Once the detachment of the gripping means 6 from the blank 2 has been performed, the collecting group 5 performs the return run to the collecting station in order to commence a new operating cycle, while the second gripping means 16 of the opening group 15 continue with the opening run of the blank (FIG. 5). During this run, the tubular blank 2 engages the shaped rod 21 of the folding organ 20 with the free side 2D of the lower surface, i.e. the side not engaged by the suckers. The rod 21 cooperates with the progressive unfolding or opening of the tubular blank 2 (FIG. 6).

Figure 6:
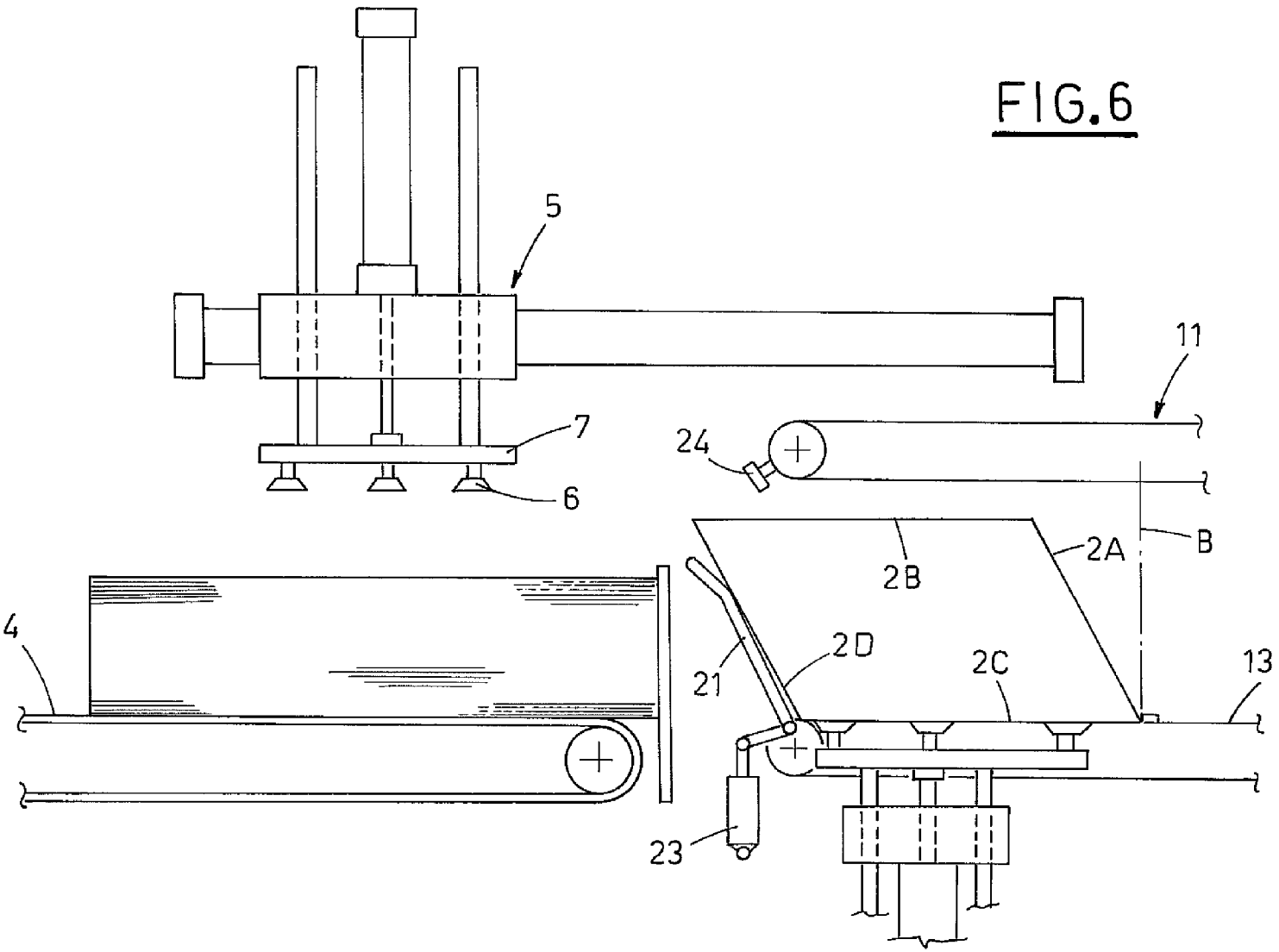

When the gripping means 16 of the opening group 15 reach the lower end run position, the base side 2C of the tubular blank 2 is resting on the lower conveyor belt 13 of the transport line 11, with the front folding line breasting a fixed reference plane, denoted by broken line B (see FIG. 6).

Figure 7:
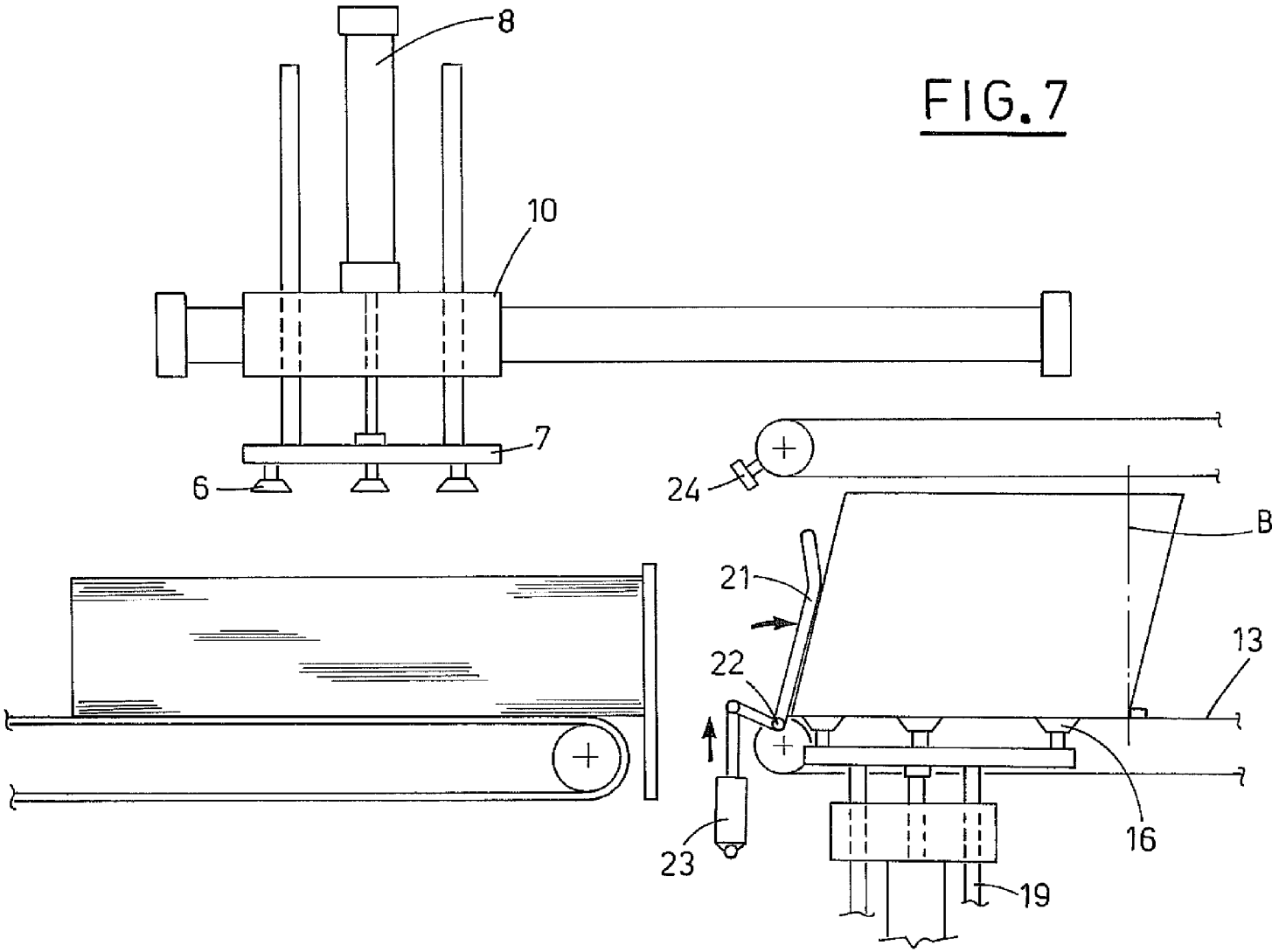

At this point the angular rotation of the rod 21 of the folding organ is activated, which is oscillatable on command of the actuator organ 23 (FIG. 7). The angular rotation determines a corresponding rotation of the free side of the blank 2 with respect to the base side engaged by the second gripping means 16. In particular, the angular rotation extends by an amount which is such as to exceed the perpendicular configuration between the two adjacent sides, i.e. to determine between the sides an inclination of less than 90°, such as to cause a weakening of the material at the score line. This ensures a subsequent maintaining of the open conformation of the tubular blank with the adjacent sides perpendicular to one another.

Figure 8:
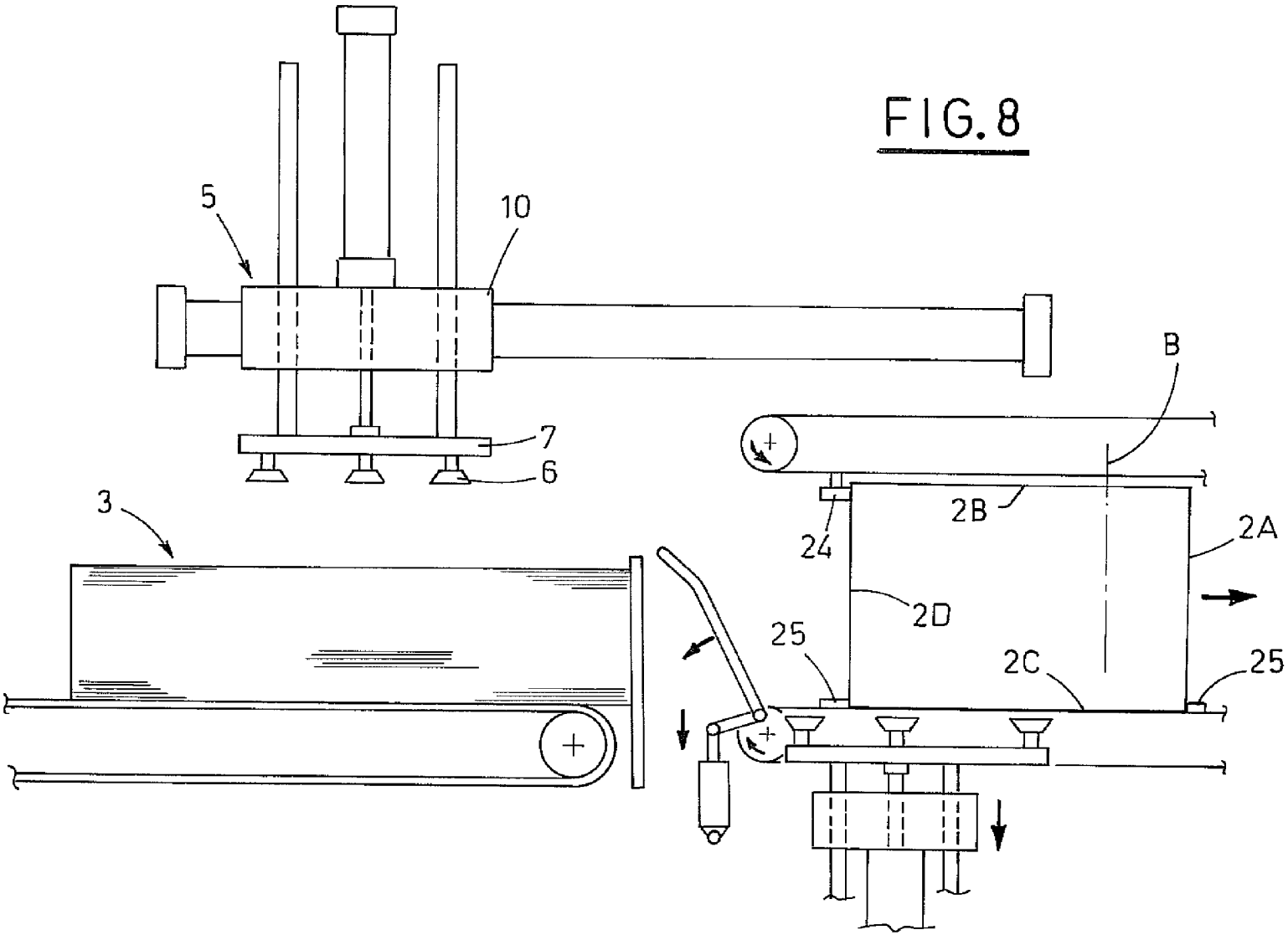

The tubular blank 2 when opened out is finally released by the gripping means 16 of the opening group 15 and is sent on to subsequent packing stages via the transport line 11 (FIG. 8). During transport, the opened-out blank 2 is retained in a known way between stop means 24, 25 borne at a suitable distance by the conveyor belts 12, 13.

The conveyor belts 12, 13 are adjustably reciprocally distanced on the basis of the size of the tubular blanks 2 being worked. The format-adjustment is preferably done by symmetrically moving both conveyor belts 12, 13. Obviously the format-adjustment also includes an appropriate regulating of the run of the opening group 15.

The device for opening-out flat-folded tubular blanks thus attains the set aim of providing a device which enables efficient and rapid opening of flat-folded tubular blanks.

This is obtained in particular thanks to the combined action of the opening organ 15 and the folding organ 20 which determines the progressive opening-out of the tubular blank 2 during an opening run.

An advantage of the device of the invention is that the tubular blank is positively retained by special gripping organs during the various operating stages of the opening cycle. In particular, the first gripping means 6 grip the flat-folded tubular blank 2 over the whole of the upper surface thereof, thus preventing the facing limbs from folding during the transport stages. This is particularly important in the case of tubular blanks having a square profile, in which the score lines which separate the upper and lower surfaces are aligned on a same vertical plane, so that they might lead to a folding axis of the surfaces by effect of gravity. Obviously a folding occurring in this way might compromise a correct gripping of the blank on the part of the opening group 15. The gripping of the first gripping means 6 ensures the planarity of the tubular blank 2 and thus a correct transfer thereof to the opening group 15.

A further advantage of the device of the invention is that the tubular blank undergoes a weakening action on the part of the folding organ 20, at the moment of completion of the opening operation. This has the aim of ensuring maintenance of the desired open configuration, by preventing an elastic return of the material from causing a change in the profile of the open configuration with the consequence of possibly having to reject containers during the stage of container-filling operations.

A further advantage of the device of the present invention is that the opening of the flat-folded tubular blank 2 by the combined action of the opening organ 15 and the folding organ 20 is produced substantially at the same time as the stage of collecting the following tubular blank 2 to be opened out, with an obvious positive effect on the operating cycle velocity.

The above has been described by way of non-limiting example, and any constructional variants are considered to fall within the protective ambit of the present technical solution, as described above and as claimed herein below.

What is claimed:

1. A device for erecting flat-folded tubular blanks supplied in flat-folded form, which comprises:

a collecting group provided with first gripping means for gripping flat-folded single tubular blanks at a first surface thereof, which gripping means are alternatingly mobile in a longitudinal direction and in a phase relation with a transport line of the tubular blanks when erected, between a pick-up station of the single tubular blanks from a store, in which the tubular blanks are predisposed in a flattened folded form, and an opening station of the single tubular blanks;

an opening group arranged in the opening station and provided with second gripping means for gripping the single flat-folded tubular blanks at a second surface thereof, opposite the first surface engaged by the first gripping means, the second gripping means being mobile in a substantially vertical direction between a near gripping position of the second surface of the single tubular blanks and a distanced opening position thereof;

a folding organ arranged in the opening station for progressively engaging a free side of the second surface of the single tubular blanks during the course of the opening thereof as the second gripping means move between the gripping position and the opening position, the folding organ being oscillatable about a folding axis which is parallel to a score line of the first surface and the second surface of the single tubular blanks, for moving the free side towards an upright position for completing the erecting of the tubular blanks.

2. The device of claim 1, wherein the first surface is bisected by a score line to define two sides on the first surface, the first gripping means of the gripping group engaging the two sides on the first surface of the single tubular blanks.

3. The device of claim 1, wherein the second surface has a portion thereof forming a bottom base of the erected blank, the second gripping means of the opening group engaging the bottom base portion of the second surface of the single tubular blanks anteriorly according to an advancement direction of the blanks.

4. The device of claim 3, wherein the first surface and the second surface of the single tubular blanks are respective upper and lower surfaces thereof in a use position.

5. The device of claim 1, wherein the first gripping means and the second gripping means are constituted by a plurality of sucker organs arranged in an ordered fashion on a plurality of rows which are transversal to the advancement direction.

6. The device of claim 1, wherein the folding organ comprises a shaped rod which progressively engages the free side of the second surface of the tubular blanks, as the second gripping means of the opening group move towards the opening position.

7. The device of claim 6, wherein the shaped rod is pivoted about a folding axis which is parallel to a score line of the first surface and of the second surface of the tubular blanks, and is oscillatable on command of an actuator in order to complete the erecting of the tubular blanks.

8. The device of claim 7, wherein the shaped rod is oscillatable in angular rotation in order to determine a corresponding rotation of the free side of the blank with respect to a base portion of the second surface engaged by the second gripping means of the opening group.

9. The device of claim 8, wherein the angular rotation of the free side extends for an amount which is suitable for over-running a configuration of perpendicularity between two adjacent sides, such as to determine between the two adjacent sides an inclination of less than 90°, and such as to determine a weakening of the material at the creasing line between the adjacent sides.

10. A device for erecting flat-folded tubular blanks supplied in flat-folded form, which comprises:

a collecting group provided with first gripping means for gripping flat-folded single tubular blanks at a first surface thereof, which gripping means are alternatingly mobile in a longitudinal direction and in a phase relation with a transport line of the tubular blanks when erected, between a pick-up station of the single tubular blanks from a store, in which the tubular blanks are predisposed in a flattened folded form, and an opening station of the single tubular blanks;

an opening group arranged in the opening station and provided with second gripping means for gripping the single flat-folded tubular blanks at a second surface thereof, opposite the first surface which is then disengaged by the first gripping means, for return to pick up a subsequent single tubular blank, the second gripping means being movable in a vertical translation between a near gripping position of the second surface of the single tubular blanks and a distanced opening position thereof;

a folding organ arranged in the opening station for progressively engaging a free side of the second surface of the single tubular blanks during the course of the opening thereof by the second gripping means operating between the gripping position and the opening position, the folding organ being oscillatable about a folding axis which is parallel to a score line of the first surface and the second surface of the single tubular blanks, for moving the free side towards an upright position for completing the erecting of the tubular blanks.

11. The device of claim 10, wherein the first surface is bisected by a score line to define two sides on the first surface, the first gripping means of the gripping group engaging the two sides on the first surface of the single tubular blanks.

12. The device of claim 10, wherein the second surface has a portion thereof forming a bottom base of the erected blank, the second gripping means of the opening group engaging the bottom base portion of the second surface of the single tubular blanks anteriorly according to an advancement direction of the blanks.

13. The device of claim 12, wherein the first surface and the second surface of the single tubular blanks are respective upper and lower surfaces thereof.

14. The device of claim 10, wherein the first gripping means and the second gripping means are constituted by a plurality of sucker organs arranged in an ordered fashion on a plurality of rows which are transversal to the advancement direction.

15. The device of claim 10, wherein the folding organ comprises a shaped rod which progressively engages the free side of the second surface of the tubular blanks, as the second gripping means of the opening group move towards the opening position.

16. The device of claim 15, wherein the shaped rod is pivoted about a folding axis which is parallel to a score line of the first surface and of the second surface of the tubular blanks, and is oscillatable on command of an actuator in order to complete the erecting of the tubular blanks.

17. The device of claim 16, wherein the shaped rod is oscillatable in angular rotation in order to determine a corresponding rotation of the free side of the blank with respect to a base portion of the second surface engaged by the second gripping means of the opening group.

18. The device of claim 17, wherein the angular rotation of the free side extends for an amount which is suitable for over-running a configuration of perpendicularity between two adjacent sides, such as to determine between the two adjacent sides an inclination of less than 90°, and such as to determine a weakening of the material at the creasing line between the adjacent sides.

19. A device for erecting flat-folded tubular blanks supplied in flat-folded form, which comprises:

a collecting group provided with first gripping means for gripping flat-folded single tubular blanks at a first surface thereof, the first surface being bisected by a score line to define two sides on the first surface, the first gripping means of the gripping group engaging the two sides of the first surface of the single tubular blanks, the gripping means being alternatingly movable in a longitudinal direction, and in a phase relation with a transport line which receives the tubular blanks when erected, between a pick-up station of the single tubular blanks from a store, in which the tubular blanks are predisposed in a flattened folded form, and an opening station of the single tubular blanks;

an opening group arranged in the opening station and provided with second gripping means for gripping the single flat-folded tubular blanks at a second surface thereof, opposite the first surface engaged by the first gripping means, the second surface having a portion thereof forming a bottom base of the erected blank, the second gripping means engaging the bottom base portion of the second surface of the single tubular blanks arranged anteriorly according to an advancement direction of the blanks, the second gripping means being movable in a substantially vertical direction between a near gripping position of the second surface of the single tubular blanks and a distanced opening position thereof;

a folding organ arranged in the opening station at a side of the opening group for progressively engaging a free side of the second surface of the single tubular blanks during the course of the opening thereof by the second gripping means moving between the gripping position and the opening position, the folding organ being oscillatable about a folding axis which is parallel to a score line of the first surface and the second surface of the single tubular blanks, for moving the free side towards an upright position for completing the erecting of the tubular blanks;

wherein the first surface and the second surface of the single tubular blanks are respective upper and lower surfaces thereof, and the folding organ comprises a shaped rod, the shaped rod connected to an actuator for controlling the shaped rod, the shaped rod being oscillatable by the actuator in order to complete the erecting of the tubular blanks.

* * * * *